United States Patent [19]

Krieger et al.

[11] Patent Number: 4,583,358

[45] Date of Patent: Apr. 22, 1986

[54] ROVING-BOBBIN FEEDER FOR SPINNING MACHINE

[75] Inventors: Eberhard Krieger, Kirchheim; Günter Schulz; Wolfgang Igel, both of Ebersbach, all of Fed. Rep. of Germany

[73] Assignee: Zinser Textilmaschinen GmbH, Ebersbach/Fils, Fed. Rep. of Germany

[21] Appl. No.: 476,546

[22] Filed: Mar. 18, 1983

[30] Foreign Application Priority Data

Mar. 20, 1982 [DE] Fed. Rep. of Germany ..... 3210329
Dec. 15, 1982 [DE] Fed. Rep. of Germany ..... 3246463

[51] Int. Cl.[4] ..... D01H 9/02; D01H 9/10; D01H 9/18

[52] U.S. Cl. ..... 57/281; 57/90; 57/267; 57/268; 57/270; 57/276; 242/35.5 R

[58] Field of Search ..... 57/281, 90, 266, 267, 57/268, 270, 276, 277, 278; 242/35.5 R, 35.5 A

[56] References Cited

U.S. PATENT DOCUMENTS

| | | | |
|---|---|---|---|
| 1,384,449 | 7/1921 | Graf | 57/266 |
| 1,463,479 | 7/1923 | Miller | 57/266 |
| 2,952,113 | 9/1960 | Ingham | 57/268 |
| 3,264,027 | 8/1966 | Luther | 57/275 X |
| 3,307,340 | 3/1967 | Nishii et al. | 57/270 X |
| 3,370,411 | 2/1968 | Schulz et al. | 57/274 |
| 3,773,191 | 11/1973 | Ishida | 57/276 |
| 3,854,275 | 12/1974 | Bethea et al. | 57/276 X |
| 3,935,699 | 2/1976 | Iida | 57/270 X |
| 4,041,686 | 8/1977 | Inaba et al. | 57/281 |

FOREIGN PATENT DOCUMENTS

| | | |
|---|---|---|
| 2225673 | 11/1972 | Fed. Rep. of Germany . |
| 1760457 | 8/1973 | Fed. Rep. of Germany . |
| 1813110 | 7/1975 | Fed. Rep. of Germany . |
| 2021498 | 3/1976 | Fed. Rep. of Germany . |
| 550734 | 5/1974 | Switzerland . |
| 1624 | of 1902 | United Kingdom . |
| 712423 | 7/1954 | United Kingdom . |
| 854968 | 11/1960 | United Kingdom . |
| 1044477 | 9/1966 | United Kingdom . |
| 1190510 | 5/1970 | United Kingdom . |
| 1437294 | 5/1976 | United Kingdom . |

*Primary Examiner*—John Petrakes
*Attorney, Agent, or Firm*—Karl F. Ross; Herbert Dubno

[57] ABSTRACT

Bobbins wound with rovings from a preparatory stage are loaded onto a carriage which receives them on an orthogonal array of horizontal pegs and transports them to a holding station for transfer, one column at a time, to a service unit moving continuously or intermittently past a multiplicity of working positions of a ring spinning machine whose spindles draw the roving from bobbins on a supply rack. The service unit, whose primary function may be that of a yarn-tying device or a traveling air blower, has a vertical conveyor with stems alignable with the pegs of the carriage in the holding station for picking up the bobbins to be transferred and delivering them, individually, to storage areas at or near the supply rack where fresh bobbins are needed as determined by a sensor aboard that unit. The storage areas may have overhead grippers onto which a bobbin is pushed from an erected stem at the upper vertex of the vertical conveyor.

8 Claims, 16 Drawing Figures

ROVING-BOBBIN FEEDER FOR SPINNING MACHINE

FIELD OF THE INVENTION

Our present invention relates to a spinning machine of the type wherein rovings are wound on bobbins in a preparatory or pre-spinning stage, these bobbins being subsequently mounted on a supply rack for feeding the rovings to spindles at respective working positions of the spinning machine proper. More particularly, our invention applies to a spinning machine provided with a service unit which moves repeatedly past the several working stations; such a unit, well known in the art, could be a traveling air blower or a thread-tying device, for example.

BACKGROUND OF THE INVENTION

In a plant of the type here considered, it is customary to place the roving-laden bobbins at the preparatory stage on a carriage for transportation to an associated spinning machine. There, an operator will lift an oncoming bobbin out of the carriage and either position it directly on the supply rack, as a replacement for an exhausted active bobbin, or store it temporarily in an adjacent area. While the circulation of a bobbin-transporting carriage between a roving frame of the preparatory stage and a given spinning machine can be automatically controlled, the removal of the arriving replacement bobbins from the carriage and their assignment to a working position in need thereof—with or without interim storage—is still a labor-intensive operation and correspondingly uneconomical.

OBJECTS OF THE INVENTION

An important object of our present invention, therefore, is to provide means in such a spinning machine for at least semiautomatically handling the transfer of replacement bobbins from a transporter to an assigned working position.

A related object is to provide means in such a spinning machine for automatically determining a location to which an oncoming replacement bobbin is to be delivered.

SUMMARY OF THE INVENTION

In accordance with our present invention, the carriage for the transportation of roving-laden replacement bobbins from a preparatory stage toward an associated spinning machine is provided with retaining means for receiving the bobbins to be transported and is arrested at a holding station near the path of a service unit of the type referred to above. The service unit has transfer means programmed to pick up one or more replacement bobbins at a time from the retaining means of the carriage for delivery to a storage area in the vicinity of the supply rack of the spinning machine.

In accordance with our invention, therefore, the service unit—in addition to its main function of tying broken yarns or blowing air, for example—carries out the heretofore manually performed tasks of taking replacement bobbins from a transporter and placing them in a storage area near the supply rack which is usually at an elevated location. The human operator is consequently relieved of the duty to lift these roving-laden bobbins and may only have to shift them from the storage area to a mandrel or other holder on the rack after removing a spent active bobbin therefrom. We shall assume, for the purpose of this description, that the latter task is performed manually even though, in principle, it could also be automated, e.g. with the aid of a donning and doffing mechanism similar to that described in commonly owned U.S. Pat. No. 3,370,411 in the names of two of us, Günter Schulz and Wolfgang Igel.

Pursuant to a more particular feature of our invention, the service unit is advantageously provided with sensing means for detecting a vacant zone of the storage area which is in need of a replacement bobbin. Under the control of the sensing means, such a replacement bobbin is delivered by the transfer means to the storage zone found to be vacant.

Still more specifically, the supply rack may be provided with monitoring means designed to detect the approaching exhaustion of an active bobbin supplying roving to a working position associated with a given storage zone. A signal from the monitoring means will then activate the sensing means aboard the service unit to deposit a replacement bobbin at that storage zone, provided of course that the same is found to be vacant. The same signal could alert the machine operator to the approaching need of substituting an available replacement bobbin for the active bobbin nearing exhaustion.

In a preferred embodiment more fully described hereinafter, the retaining means of the bobbin-transporting carriage comprises a plurality of pegs which are loadable with the replacement bobbins at the preparatory stage. The transfer means on the service unit comprises, in this instance, an endless conveyor with outwardly projecting stems which are alignable with the pegs of the carriage; a grasping device, also forming part of the transfer means, is engageable with a bobbin on any of these pegs for shifting same onto an aligned stem.

Further according to that embodiment, the storage area is provided with a plurality of overhead grippers such as those disclosed in the above-identified Schulz et al U.S. Pat. No. 3,370,411 with which the conveyor stems are individually alignable for delivery of a replacement bobbin thereto. Especially in that case it will be convenient to orient the pegs substantially horizontally on the carriage and to provide the transfer conveyor with a substantially vertical run from which the stems project codirectionally with the pegs in an alignment position, this run terminating at an upper vertex which is positionable underneath an overhead gripper to be loaded with a replacement bobbin from a stem standing erect at that vertex.

BRIEF DESCRIPTION OF THE DRAWING

The above and other features of our invention will now be described in detail with reference to the accompanying drawing in which.

SPECIFIC DESCRIPTION

Figure 1:
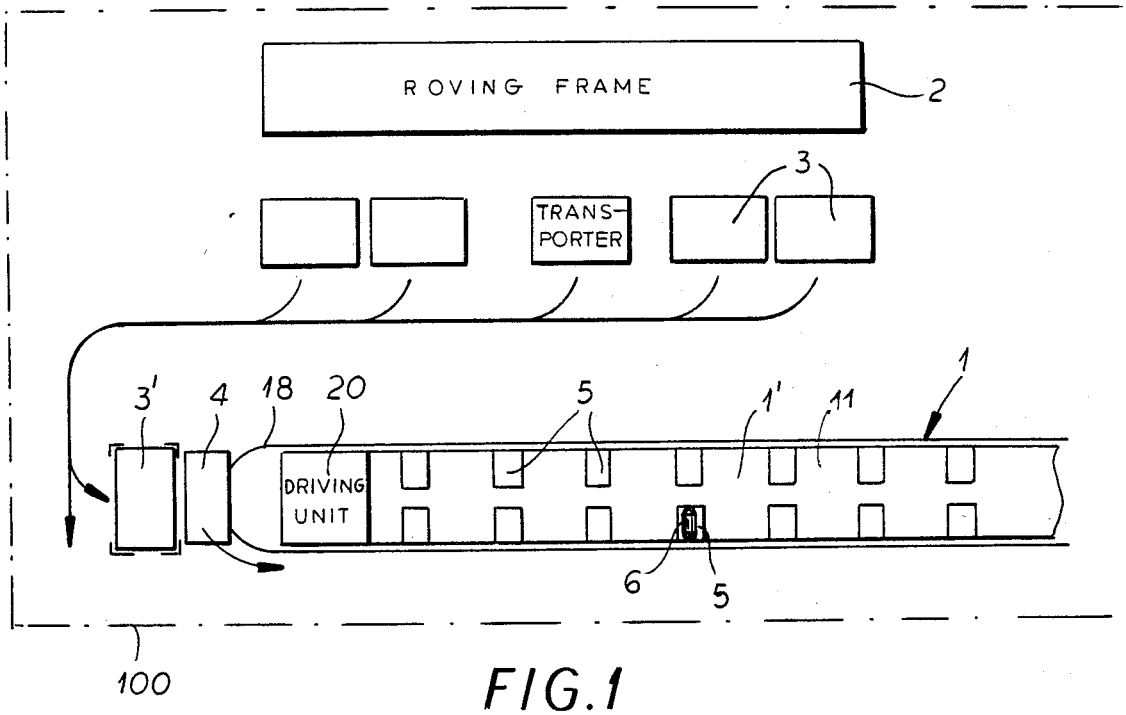
FIG. 1 is a diagrammatic plan view of a plant including a preparatory stage and a spinning machine equipped with a roving-bobbin feeder according to our invention.

In FIG. 1 we have diagrammatically illustrated part of a textile plant 100 including a spinning machine 1 of conventional structure in which rovings from a multiplicity of active bobbins (not shown), mounted on a supply rack 1', are continuously fed to respective working stations provided with the usual spindles and traveler rings, also not illustrated. A roving frame 2, forming part of a preparatory stage, supplies prewound bobbins which are loaded onto carriages 3 for transportation to spinning machine 1 or to other such machines at the plant (see carriage A of U.S. Pat. No. 3,307,340). A service unit 4 is programmed to move along a track 18 which leads past all the working stations of machine 1 and adjoins a holding station where a carriage 3', loaded with replacement bobbins from roving frame 2, is temporarily immobilized. A driving unit for the spindles and other components of machine 1 has been indicated at 20; unit 4 may be self-propelled. A bobbin handler in which a carriage moves along the length of the spinning machine and in timed sequences cooperates with a rack or bobbin transporter is described in U.S. Pat. No. 3,854,275. (See also U.K. Patent Specification No. 1,437,294).

Rack 1' is shown provided with a multiplicity of storage zones 5 each assigned to one or more working positions. At 6 we have indicated a roving-laden replacement bobbin transferred from carriage 3' to the rack 1', in a manner more fully described hereinafter, by traveling unit 4. An operator, on noting the exhaustion of an active bobbin in a working position associated with this storage zone 5, need only remove the core tube of the exhausted bobbin from its holder and replace it with the bobbin 6 present on that zone.

Unit 4 is preferably provided with a sensor, which could include a mechanical feeler (e.g. as described hereinafter with reference to FIG. 5) but may also be of the photoelectric type, designed to detect the absence of a replacement bobbin 6 on a storage zone 5 and to fill that vacancy with a bobbin picked up from carriage 3'. If unit 4 is able to carry a number of such replacement bobbins—e.g. four to six—picked up at one time from carriage 3', it may supply vacant zones in several passes around the machine 1 without having to halt each time at the holding station in order to accept new replacement rolls from carriage 3'. A transfer mechanism capable of simultaneously picking up and temporarily retaining a multiplicity of such replacement bobbins, e.g. as described hereinafter with reference to FIGS. 6–16, may then signal a programmer aboard unit 4 that its supply of bobbins has been depleted whereupon the programmer will command a halting adjacent carriage 3' on the next pass; the same programmer, of course, will respond to the sensor to let the transfer mechanism deliver a fresh bobbin to a storage zone found to be vacant. Alternatively, the programmer may command a halting of unit 4 and a reloading of its transfer mechanism with fresh bobbins whenever that unit passes the holding station.

It will be understood that several spinning machines 1 could be served by the same traveling unit 4.

Figure 2:
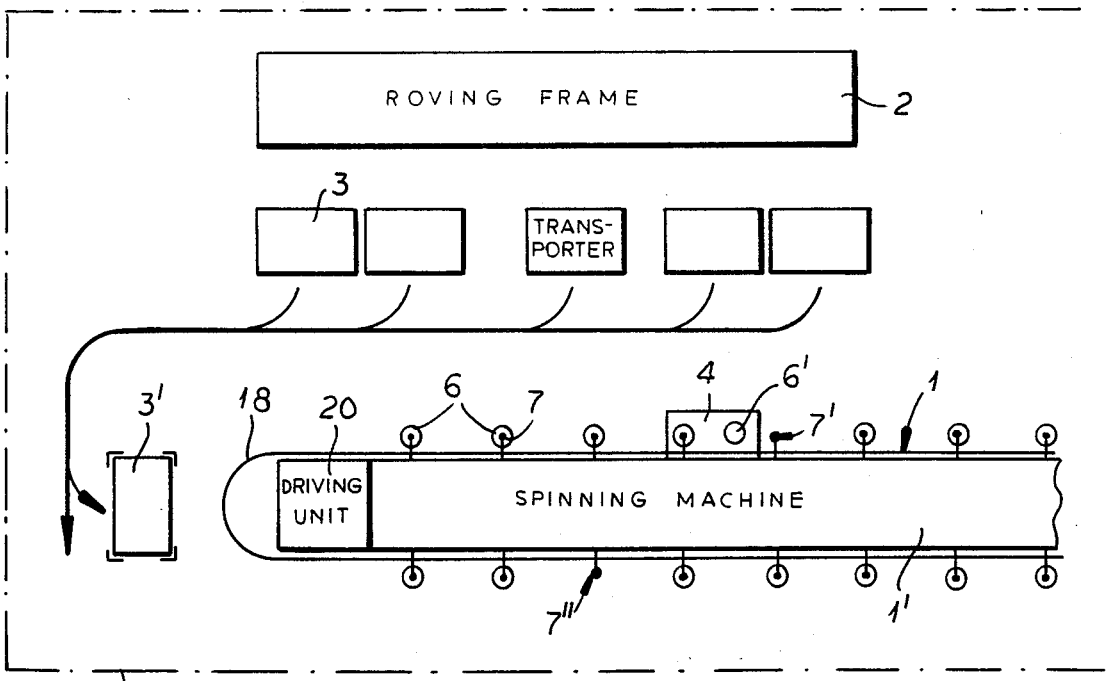
FIG. 2 is a view similar to FIG. 1, illustrating a modification.

In FIG. 2 we have illustrated a similar textile plant wherein, however, the supply rack 1' is provided with stationary overhead grippers which overhang the rack 18 of service unit 4 in respective storage zones 7 each associated again with one or more working positions of machine 1. As shown, most of these storage areas 7 are occupied by replacement bobbins 6 suspended from their grippers; two such zones, designated 7' and 7'', are found to be vacant. When the first vacancy is detected by the sensor of unit 4, a replacement bobbin 6' carried on that unit will be delivered to the corresponding gripper. If unit 4 still has another replacement bobbin available on traversing the second vacant zone, the latter will also be supplied. The combined storage capacity of carriage 3' and service unit 4 will, of course, enable continued operation of spinning machine 1 even if the roving frame 2 should temporarily fail to produce further bobbins.

Figure 3:
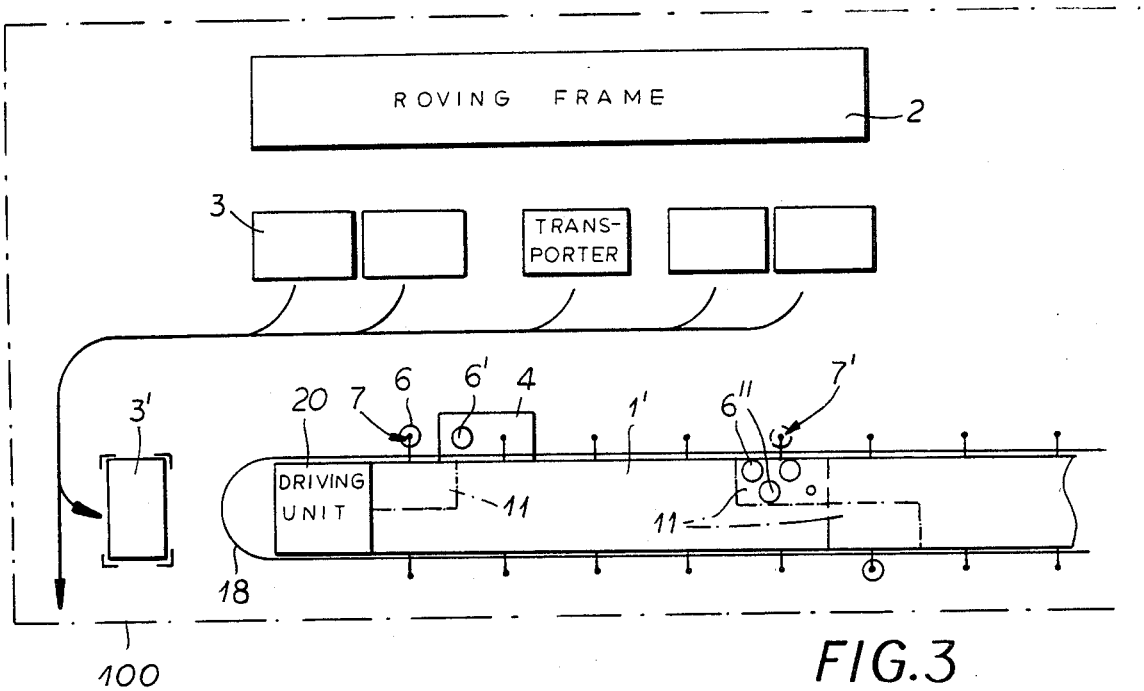
FIG. 3 is a view similar to FIG. 2, showing additional details.
Figure 4:
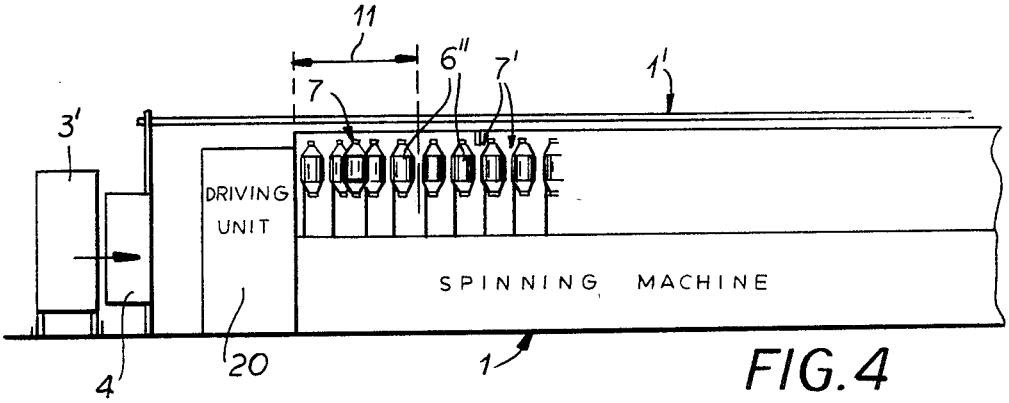
FIG. 4 is a diagrammatic elevational view of the assembly of FIG. 3.

In FIGS. 3 and 4, which show the same plant as FIG. 2, we have diagrammatically indicated at 11 several regions of supply rack 1' associated with respective storage zones 7, each of these regions encompassing a plurality of working positions schematically represented by active bobbins 6''. One such region 11 has been illustrated in detail in FIG. 5 which also shows the guide track 18 of service unit 4 as comprising an overhead rail engaging rollers 19 (only one shown) on an upward extension **4*a* of that unit. As will be apparent from subsequently described FIGS. 6 and 16, unit 4** also has wheels riding on the floor of the plant.

Figure 5:
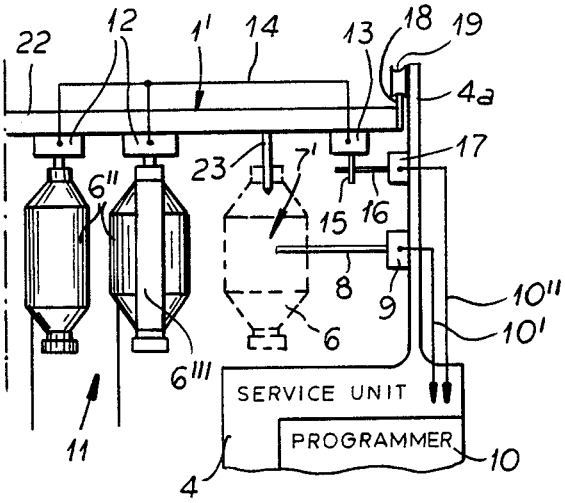
FIG. 5 is an elevational detail view of part of that assembly, drawn to a larger scale.

FIG. 5 shows two active bobbins 6'' still containing significant amounts of roving while a third bobbin has been exhausted so as to leave only its core tube 6'''. All three of these bobbins are suspended from rack 1' through the intermediary of conventional weight sensors 12 which detect their approaching exhaustion and thereupon emit a signal on a respective lead 14 to an indicator 13. This indicator, in the present instance, is shown to comprise a pin 15 which is extended downward in response to such a signal to trip a horizontally swingable arm 16 of a switch 17 mounted on extension **4*a* of unit 4. A similar switch 9 has a horizontally swingable arm 8 which projects toward an associated storage zone 7' found to be vacant in the absence of a replacement bobbin 6. Switch 9, therefore, acts as a mechanical sensor detecting the vacant or occupied state of such a storage area. Signal lines 10' and 10'' extend from switches 9 and 17 to a programmer 10 aboard service unit 4 which operates in the afore-described manner to command a reloading of the vacant zone. Such reloading, of course, could not take place if zone 7' were still occupied by a replacement bobbin 6 as indicated in phantom lines; in that instance the signal on lead 10'' would merely alert the operator that an active bobbin has been or is about to be exhausted and that the available replacement bobbin 6** should be substituted therefor.

The weight sensors 12 and the indicator 13 are shown mounted on a beam 22 of rack 1' also carrying an overhead gripper schematically represented by a pin 23. The gripper, of course, will have to be fitted with a suitable detent means for releasably retaining a bobbin 6 in position thereon. The track 18 supporting the rollers 19 of unit 4 is seen to form a rail along the edge of beam 22.

Figure 6:
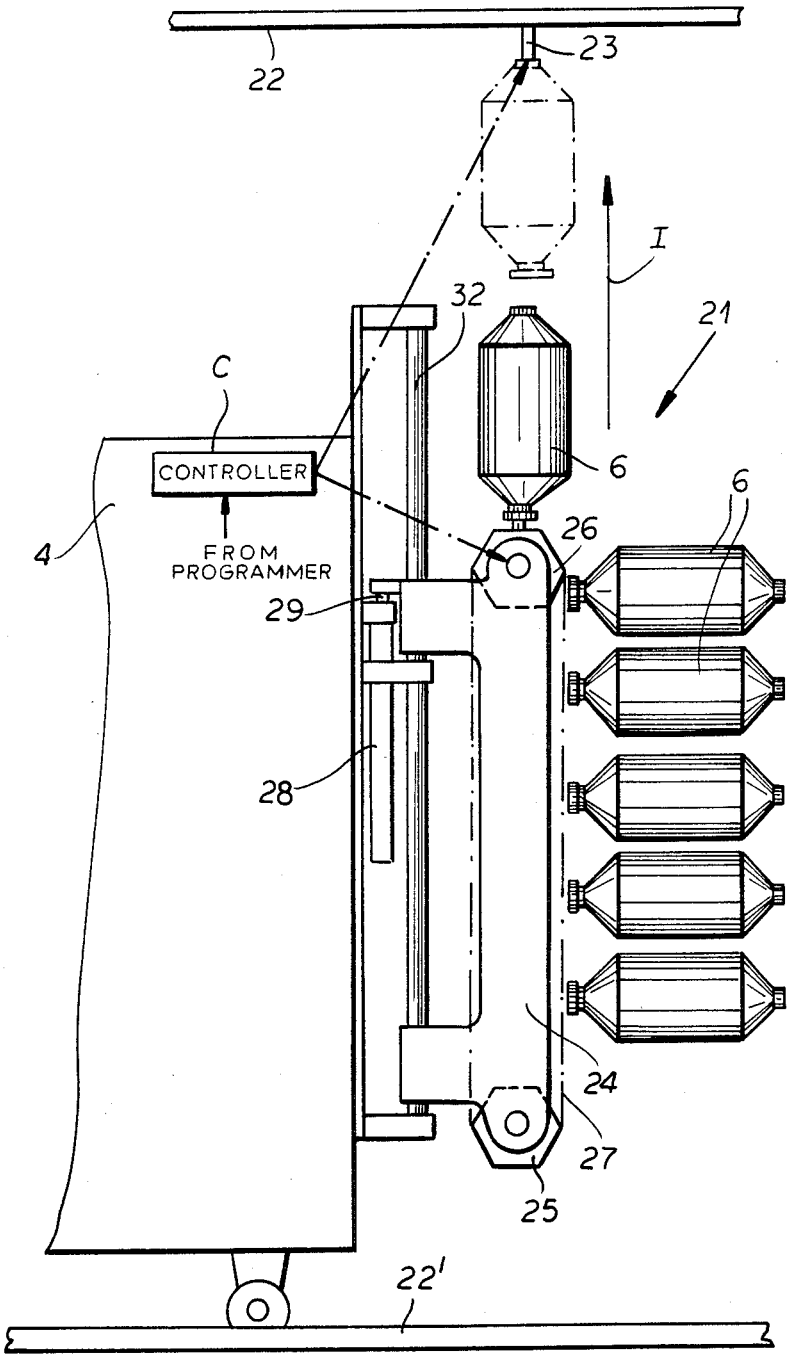
FIG. 6 is an elevational view showing details of a transfer mechanism usable in the assembly of FIGS. 2–5.
Figure 7:
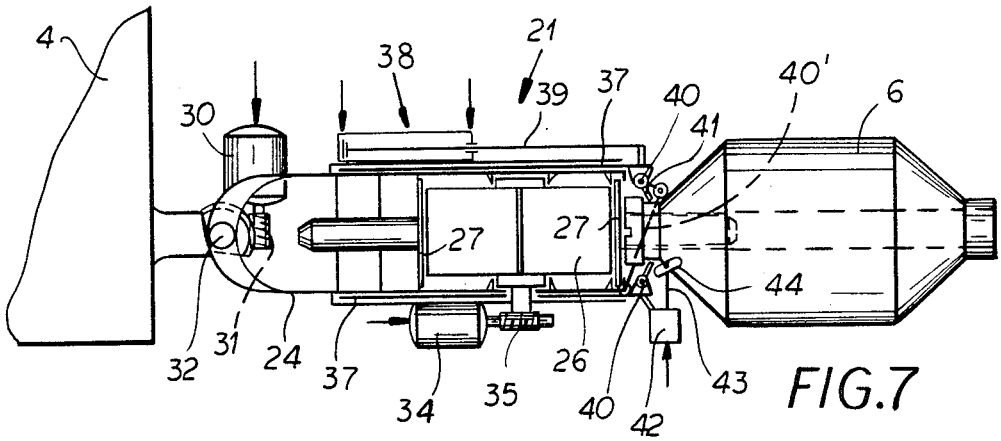
FIG. 7 is a top view of the structure of FIG. 6.
Figure 8:
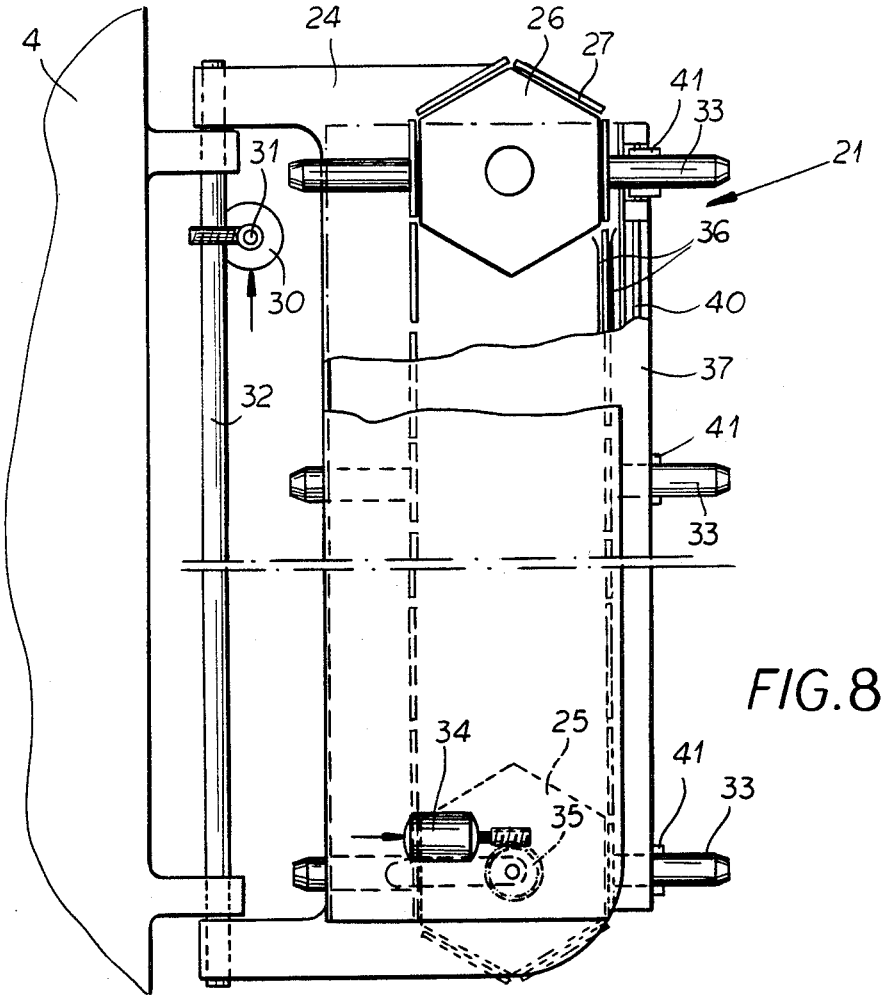
FIG. 8 is a view similar to that of FIG. 6 but drawn to a larger scale, showing further details.

FIGS. 6–8 show a transfer mechanism, generally designated 21, which is mounted on the service unit 4 and serves to extract a group of fresh replacement bobbins from carriage 3' and to deliver these bobbins one by one to overhead grippers of a vacant storage zone such as those indicated at 7' and 7'' in FIGS. 2 and 5. Carriage 3', as schematically indicated in FIGS. 9–15, comprises a rack with an array of pegs 45 which preferably form an orthogonal matrix with a plurality of columns, four such columns being represented in these Figures by individual bobbins 6 disposed in a horizontal row of the matrix. In the event of a 4×5 matrix, for example, the carriage will hold 20 bobbins upon arriving from the roving frame 2 of FIGS. 2 and 3; in practice, however, that number could be considerably larger, e.g. 80 distributed over 10 columns of 8 pegs each. Overhead grippers are described in U.K. Patent Specification Nos. 712,423 and 1,044,477.

Transfer mechanism 21 comprises a vertical conveyor in the form of an endless chain 27 with links embracing polygonal (here hexagonal) end rollers 25 and 26 carried on a frame 24. Chain 27 has two vertical runs, one on the right facing the outside in order to confront a column of the array of pegs 45 when unit 4 is halted adjacent carriage 3'. Some of the links of conveyor chain 27 carry outwardly projecting stems 33 which are alignable with the pegs 45 of one column for a shifting of up to five bobbins from the pegs onto the vertically spaced stems. Such a shift is effected by a grasping device comprising a slider 37 which brackets the frame 24 and is horizontally reciprocable thereon by means of a fluidic jack 38 provided with a piston rod 39. The front end of slider 37 carries two vertical shafts 40 at opposite sides of the exposed vertical run of the conveyor chain 27. Shafts 40, which are interconnected by a Z-shaped linkage 40', are swingable in mutually opposite directions by a fluidic jack 42 whose piston rod 43 is coupled with one of these shafts by a slotted link 44. The two shafts 40 carry a plurality of pairs of symmetrical lugs 41 which are normally spread apart and can be swung toward each other behind the neck of a confronting bobbin 6 for drawing it onto a stem 33 aligned with its supporting peg. There are, accordingly, five such lug pairs respectively bracketing the horizontally projecting stems 33 in the position of FIG. 6 in which, however, the grasping device 37 has been omitted for clarity's sake.

FIG. 24 is swingable about a vertical shaft 32, through an angle of about 90°, with the aid of a servomotor 30 and a worm 31 engaging a worm gear keyed to that shaft. A third fluidic jack 28, fixedly mounted on unit 4, has a piston rod 29 which engages the frame 24 for elevating it toward an overlying gripper 23 depending from beam 22. Since that beam extends in the direction of the guide track of unit 4, which in FIG. 6 is marked by a bottom rail 22', conveyor frame 24 must be aligned with that track when a bobbin is to be delivered to a vacant gripper 23 thereabove. For picking up bobbins from carriage 3', on the other hand, the frame must be in its alternate position perpendicular to the guide track. Such a loading of gripper 23 is accomplished by operation of jack 28 while a bobbin 6 lies on an erected stem 33 above the upper vertex of the conveyor defined by its roller 26. As the frame 24 moves upward along shaft 32, the vertically positioned bobbin is lifted into engagement with gripper 23 as indicated by an arrow I in FIG. 6. A stepping motor 34, connected with the shaft of the lower end roller 25 via another worm coupling 35, advances the conveyor chain 27 by a distance equal to the separation of adjacent stems 33 after the frame 24 has been lowered to its normal level; thus, the next stem 33 with its bobbin is erected into a position of potential co-operation with another gripper 23 found to be vacant.

Figure 9:
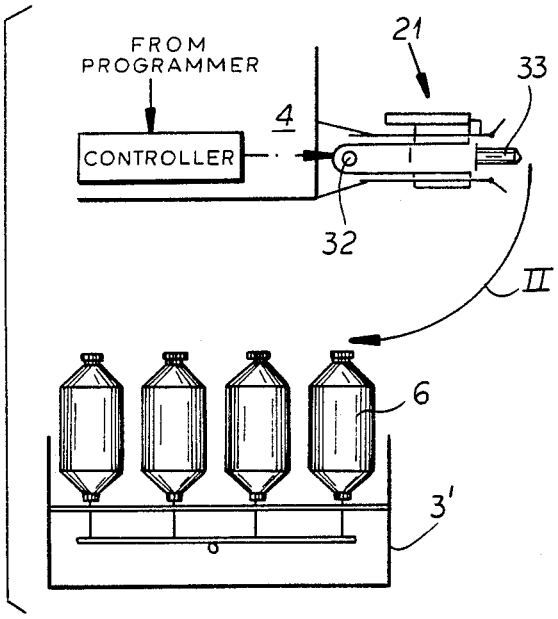
FIGS. 9–15 are motion diagrams seen from above illustrating successive phases in the operation of the transfer mechanism of FIGS. 6–8.
Figure 11:
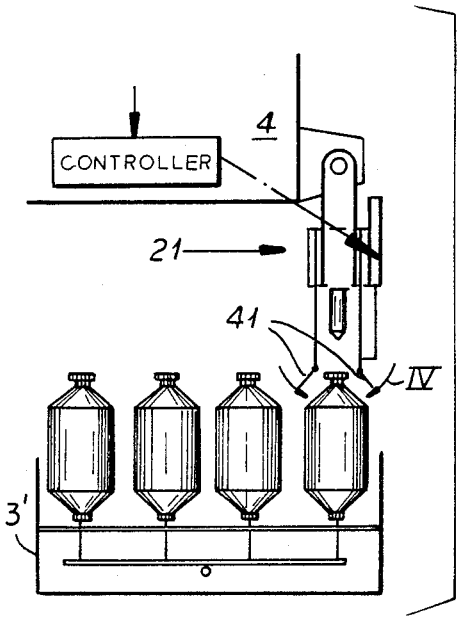
Figure 10:
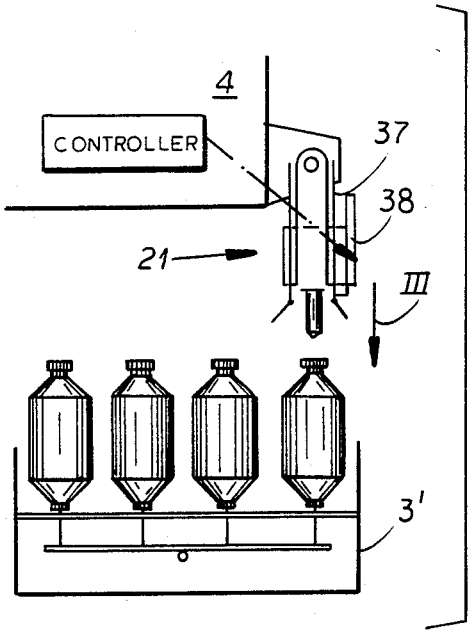
Figure 12:
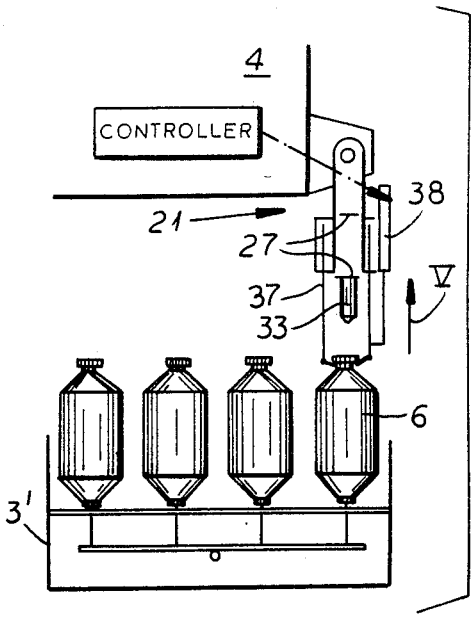
Figure 13:
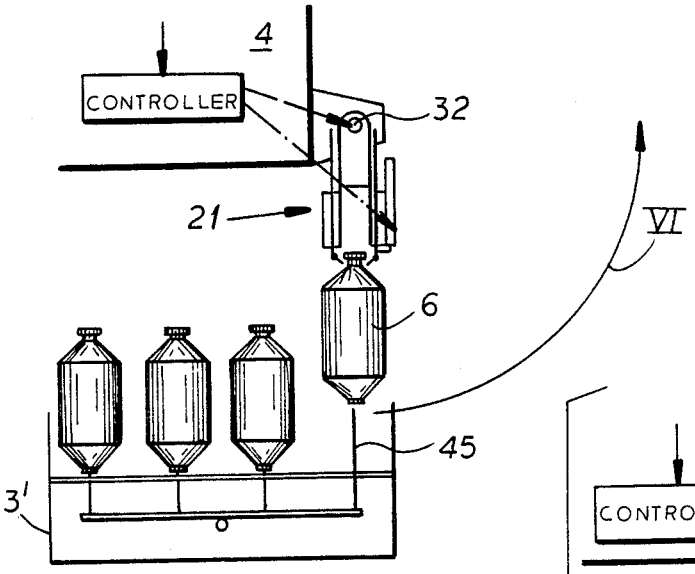
Figure 15:
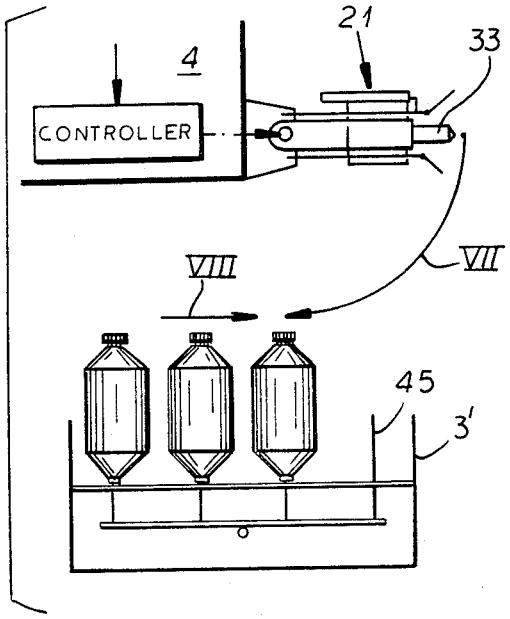
Figure 14:
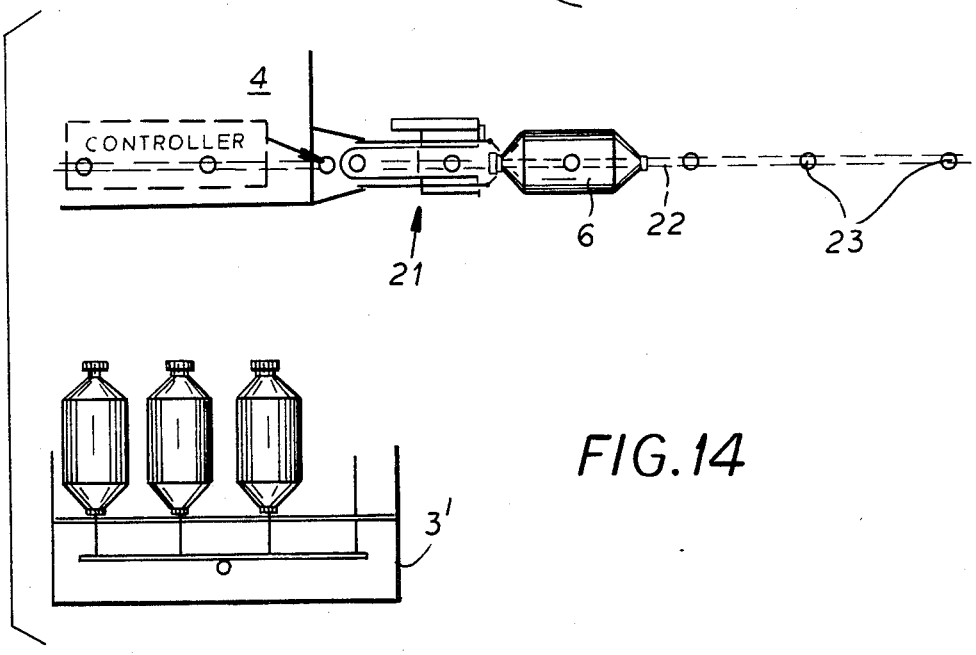

When all the bobbins carried on conveyor chain 27 have thus been transferred, programmer 10, operating through a controller C, arrests the unit 4 on its next traverse of the holding station in a pick-up position in which a column of bobbins 6 on carriage 3' confronts the horizontally projecting stems 33 of the transfer conveyor after its frame has been swung into its alternate position as indicated by an arrow II in FIG. 9. With stems 33 and pegs 45 now aligned, slider 37 operates to extract the bobbins of the confronting column from the carriage and place them on the conveyor stems. The forward motion of the slider, indicated by an arrow III in FIG. 10, is followed by an inward swing of lugs or claws 41 as denoted by an arrow IV in FIG. 11. Next, as indicated by an arrow V in FIG. 12, the slider 37 is retracted with the engaged bobbins into the position of FIG. 13 preparatorily to a swing of frame 24 into its first position aligned with the direction of motion of unit 4, according to an arrow VI. With transfer mechanism 21 now pointing forward as shown in FIG. 14, the sensor of unit 4 scans the overhead grippers 23 in its motion along beam 22 in order to supply the vacant ones as described above. FIG. 15 shows a subsequent traverse of the holding station where, with transfer mechanism 21 now devoid of bobbins, its frame 24 is swung back into confrontation with carriage 3' as indicated by an arrow VII. Since, however, the first column of the retaining rack of the carriage no longer holds any bobbins, the carriage is now displaced by one step to align the next column with the horizontally projecting stems 33 as denoted by an arrow VIII. The same sequence of operations is then repeated. An apparatus for the removal of filled bobbins with a swing action is described in Swiss patent No. 550,734.

Figure 16:
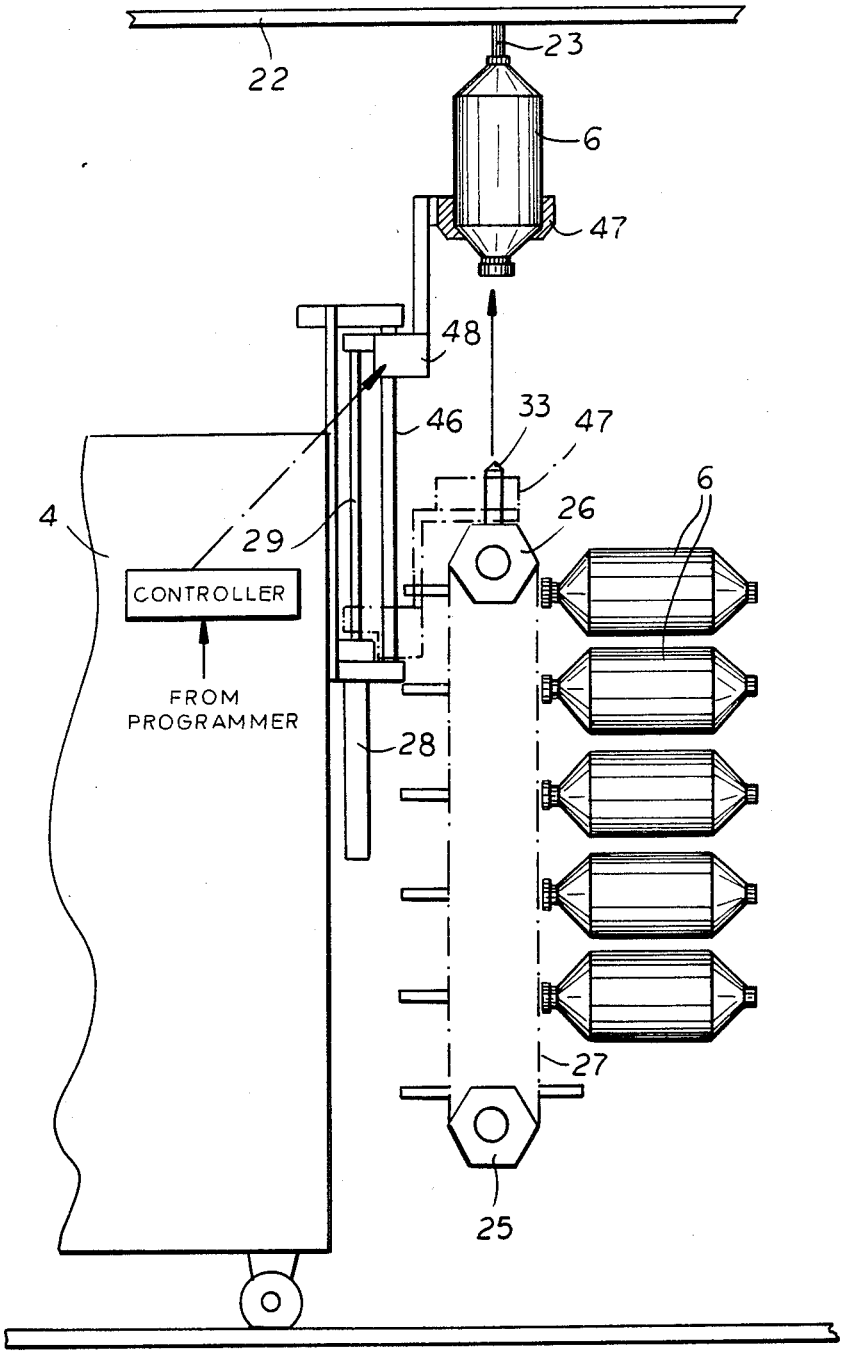
FIG. 16 is another view similar to FIG. 6, showing a modification.

In FIG. 16 we have shown a modification of the transfer mechanism according to which the conveyor 25–27 is no longer vertically shiftable but a pusher 47 is mounted on a rod 46 for elevation by jack 28 when a bobbin 6 is to be delivered to an overhanging gripper 23. Pusher 47 has two concave jaws separated by a gap which allows them to clear the converging bottom end of an erected bobbin 6 to be transferred. The operation of this mechanism is otherwise identical with that described above.

We claim:

1. In a spinning machine provided with a multiplicity of working positions wherein rovings produced in a preparatory stage are drawn from active bobbins mounted on holders of a supply rack, the combination therewith of:

a carriage provided with retaining means for transporting roving-laden replacement bobbins from said preparatory stage to a holding station;

a service unit programmed to move repeatedly past said working positions and said holding station; and transfer means on said service unit programmed to grip and thereby pick up at least one replacement bobbin at a time from said retaining means and deliver same to a storage area in the vicinity of said holders, said storage area being divided into a multiplicity of zones each associated with at least one working position, further comprising sensing means aboard said service unit for detecting a vacant zone in need of a replacement bobbin, said transfer means being controlled by said sensing means for delivering a pick-up replacement bobbin to such a vacant zone, said retaining means comprising a plurality of pegs loadable at said preparatory stage with respective replacement bobbins, said transfer means comprising an endless conveyor with outwardly projecting stems alignable with said pegs and grasping means engageable with a bobbin on any of said pegs for shifting same onto a stem aligned therewith.

2. The combination defined in claim 1 wherein said storage area is provided with a plurality of overhead grippers, said stems being individually alignable with any of said grippers for delivery of a replacement bobbin thereto.

3. The combination defined in claim 2 wherein said pegs extend substantially horizontally, said conveyor having a substantially vertical run from which said stems project codirectionally with said pegs in an alignment position, said run terminating at an upper vertex positionable underneath an overhead gripper to be loaded with a replacement bobbin from a stem erected at said vertex.

4. The combination defined in claim 3 wherein said conveyor is upwardly movable for delivering a bobbin from an erected stem to an overhead gripper in line therewith.

5. The combination defined in claim 3 wherein said transfer means further includes vertically reciprocable pusher means for stripping a bobbin from an erected stem and thrusting same onto an overhead gripper in line therewith.

6. The combination defined in claim 3 wherein said pegs are arrayed on said carriage in at least one vertical column, said stems being disposed on said conveyor with a spacing corresponding to that of the pegs in said column, said run accommodating a plurality of stems concurrently alignable with respective pegs of said column and loadable by said grasping means with replacement bobbins supported thereon.

7. The combination defined in claim 3 wherein said grasping means comprises a horizontally movable slider with arms bracketing said run, a pair of vertical shafts on said arms coupled for joint rotation in opposite directions, and at least one pair of counterrotating lugs on said shafts engageable with a neck of a replacement bobbin on a confronting peg.

8. The combination defined in claim 7 wherein said holding station is disposed adjacent a track guiding said service unit, said conveyor and said slider being provided with a support swingable on said service unit about a vertical axis between a first position in line with the direction of motion of said unit and a second position substantially perpendicular thereto, said stems being alignable with said pegs in said second position and with said overhead grippers in said first position.

* * * * *